US005573433A

United States Patent [19]

Lin et al.

[11] Patent Number: 5,573,433

[45] Date of Patent: Nov. 12, 1996

[54] ELECTRIC WIRE CONNECTOR

[76] Inventors: Kuang-Ts'an Lin; Shih-Tsung Liang, both of No. 10, Lane 31, Ta-Feng St., Lu-Chu Hsiang, Taoyuan County, Taiwan

[21] Appl. No.: 556,653

[22] Filed: Nov. 13, 1995

[51] Int. Cl.[6] ..... H01R 4/38

[52] U.S. Cl. ..... 439/805

[58] Field of Search ..... 439/805, 784, 439/891

[56] References Cited

U.S. PATENT DOCUMENTS

| | | | |
|---|---|---|---|
| 1,393,704 | 10/1921 | Schwarzmann | 439/805 X |
| 1,583,697 | 5/1926 | Latham | 439/805 X |
| 1,701,801 | 2/1929 | VanGale | 439/805 OR |
| 2,441,457 | 5/1948 | Treanor | 439/805 X |
| 2,659,062 | 11/1953 | Tibbetts | 439/805 X |

*Primary Examiner*—Gary F. Paumen
*Assistant Examiner*—Daniel Wittels
*Attorney, Agent, or Firm*—Morton J. Rosenberg; David I. Klein

[57] ABSTRACT

An improved electric wire connector includes a hollow tubular fitting element and a hollow tubular plug element inserted into a front end of the fitting element. The plug element has an annular curved rim which may press against a front edge of the fitting element when the plug element is inserted into the fitting element. The fitting element is further provided with external threads at a middle section thereof for enabling the fitting element to be screwably inserted into a screw hole of a conductive element. An electric wire has the plastic skin at a front end portion thereof stripped to expose the wire strands. The electric wire is inserted via a rear end of the fitting element with the stripped skin pressing against a rear end of the plug element so that the wire strands pass through the fitting element and the plug element to expose on the outside. The wire strands are bent inwardly to lie against the curved rim so that it may be held firmly between the curved rim of the plug element and the fitting element after the fitting element is fitted together with the plug element into the conductive hole, thereby preventing the electric wire from possible damage.

1 Claim, 2 Drawing Sheets

ELECTRIC WIRE CONNECTOR

BACKGROUND OF THE INVENTION (a) Field of the Invention

The present invention relates generally to an improved electric wire connector.

(b) Description of the Prior Art

A conventional electric wire connector is shown in FIGS. 3 and 4. It mainly consists of a hollow tubular threaded fitting 5 for receiving an electric wire 7 inserted therein and a conductive element 6. The electric wire 7 is inserted into the threaded fitting 5 via a rear end thereof until the exposed wire strands 71 at a front end of the electric wire 7 pass through a front end of the threaded fitting 5. The exposed wire strands 71 are then bent inwardly to rest against the circumference of a rod portion 51 at the front end of the threaded fitting 5. The threaded fitting 5 may be screwably fitted into a screw hole 61 formed in a bottom end of the conductive element 6 by means of external threads formed at a middle section thereof. However, since the rod portion 51 and the threaded fitting 5 are integrally formed, the rod portion 51 is also caused to turn when the threaded fitting 5 is turned. The consequence is that the exposed wire strands 71 squeezed between the rod portion 51 and the inner wall of the screw hole 61 may be easily split as a result of friction caused by the turning of the threaded fitting 5 inside the conductive element 6, or the conductivity of the electric wire 7 may be undermined.

SUMMARY OF THE INVENTION

A primary object of the present invention is to provide an electric wire connector which is convenient to connect and may ensure the electric wire against possible frictional damage and may maintain good conductivity.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 2:
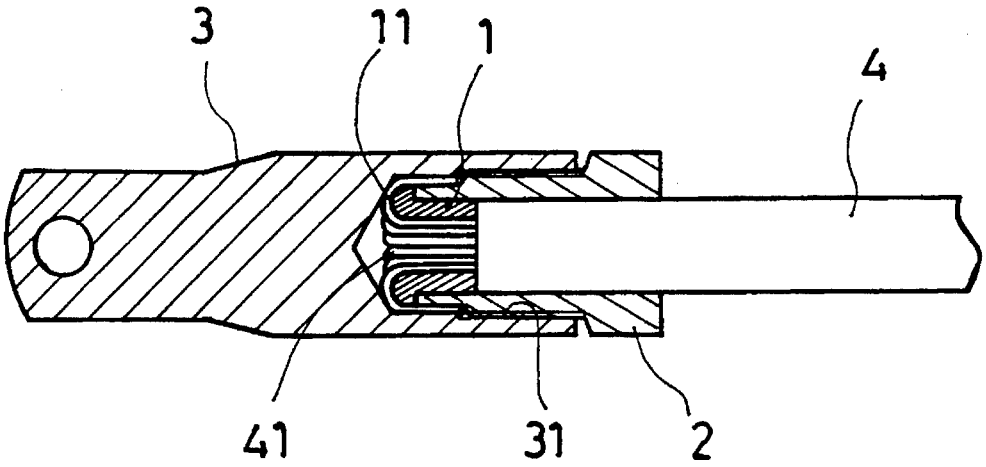
FIG. 2 is a sectional view of the electric wire connector according to the present invention.
Figure 1:
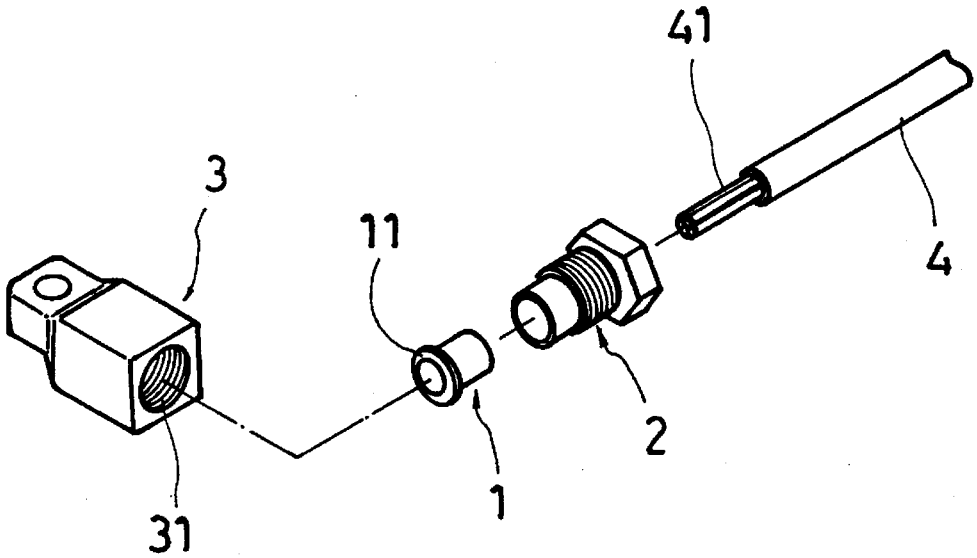
FIG. 1 is a perspective exploded view of the electric wire connector according to the present invention.
Figure 4:
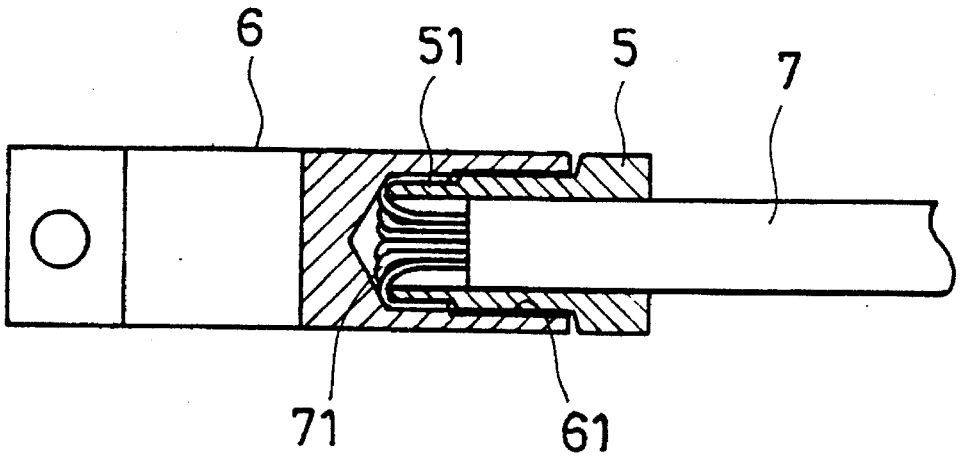
FIG.4 PRIOR ART
FIG. 4 is a sectional view of the conventional electric wire connector.
Figure 3:
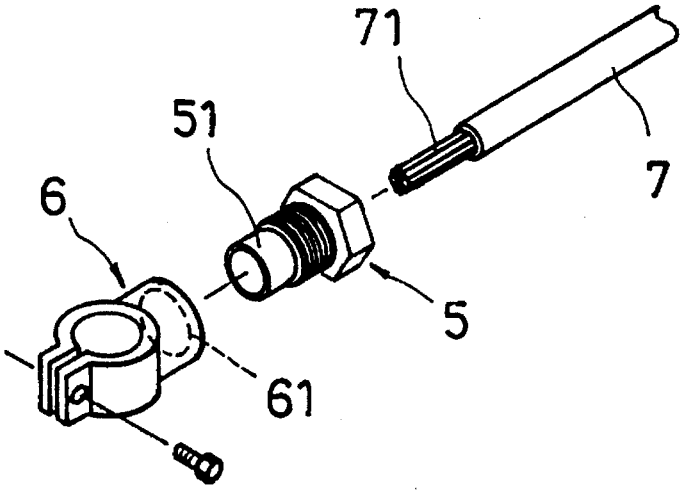
FIG.3 PRIOR ART
FIG. 3 is a perspective exploded view of a conventional electric wire connector.

With reference to FIGS. 1 and 2, the electric wire connector according to the present invention essentially comprises a hollow tubular fitting element 2, a hollow tubular plug element 1 fitted into a front end of the fitting element

2, the plug element 1 having an annular curved rim 11 which may press against a front rim of the fitting element 2 when the plug element 1 is inserted into the fitting element 2. The fitting element 2 has external threads provided at a middle section thereof, whereby the fitting element 2 may be screwably fitted into a screw hole 31 of a conductive connector 3. An electric wire 4 has the plastic skin at a front portion thereof stripped to expose a suitable length of wire strands 41. The electric wire 4 is then inserted with its front portion into the fitting element 2 via a rear end thereof with the stripped plastic skin just urging against a rear end of the plug element 1 and the wire strands 41 passing through the fitting element 2 and the plug element 1 to expose on the outside of the plug element 1. The exposed wire strands 41 are then bent inwardly to lie against the curved rim 11. At this time, when the fitting element 2 is screwably fitted into the conductive connector 3, since the plug element 1 will not synchronously turn with the fitting element 2, the exposed wire strands 11 may be held tightly between the curved rim 11 and the screw hole 31 of the conductive connector 3, preventing the exposed wire strands 41 from possible damage due to friction which may in turn undermine the conductivity of the electric wire 7.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved electric wire connector comprising:

a hollow tubular fitting element having external threads provided at a middle section thereof for enabling said fitting element to be screwably fitted into a screw hole of a conductive element, and a hollow tubular plug element for insertion into a front end of said fitting element, said plug element having an annular curved rim at an end thereof for pressing against the front edge of said fitting element after said plug element is inserted into the front end of said fitting element, wherein after said plug element is inserted into the front end of said fitting element, an electric wire with the plastic skin at a front portion thereof stripped to expose a suitable length of wire strands is inserted into said fitting element via a rear end thereof such that the stripped plastic skin of said electric wire just presses against a rear end portion of said plug element and said wire strands pass out through a rear end of said plug element to be exposed on the outside of said plug element, said wire strands being bent inwardly to lie against said curved rim and prevented from possible breaking or damage due to friction when said fitting element together with said plug element is inserted into said conductive element since said wire strands may be firmly held between said curved rim and said conductive element.

* * * * *